US010969089B1

(12) United States Patent
Bashleben

(10) Patent No.: US 10,969,089 B1
(45) Date of Patent: Apr. 6, 2021

(54) PIVOTING SWIVEL ILLUMINATION DEVICE

(71) Applicant: Snap-on Incorporated, Kenosha, WI (US)

(72) Inventor: Craig Bashleben, Arlington Heights, IL (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 16/736,406

(22) Filed: Jan. 7, 2020

(51) Int. Cl.

| | |
|---|---|
| ***F21V 21/00*** | (2006.01) |
| ***F21V 21/30*** | (2006.01) |
| ***F21L 4/04*** | (2006.01) |
| ***F21V 21/096*** | (2006.01) |
| ***F21L 4/00*** | (2006.01) |
| ***F21V 23/04*** | (2006.01) |
| ***F21V 21/14*** | (2006.01) |
| ***F21V 23/02*** | (2006.01) |
| ***F21V 21/08*** | (2006.01) |

(52) U.S. Cl.
CPC ..... *F21V 21/30* (2013.01); *F21L 4/005* (2013.01); *F21L 4/045* (2013.01); *F21V 21/08* (2013.01); *F21V 21/096* (2013.01); *F21V 21/0965* (2013.01); *F21V 21/14* (2013.01); *F21V 21/145* (2013.01); *F21V 23/02* (2013.01); *F21V 23/0414* (2013.01)

(58) Field of Classification Search
CPC .... F21V 21/30; F21V 21/0965; F21V 21/145; F21V 21/096; F21V 21/08; F21V 21/14; F21V 23/0414; F21V 23/02; F21L 4/005; F21L 4/045
USPC ..... 362/191, 188, 190, 398
See application file for complete search history.

(56) References Cited

U.S. PATENT DOCUMENTS

| | | | | | |
|---|---|---|---|---|---|
| 2,910,310 | A * | 10/1959 | Mulac | F16C 11/0604 | 285/91 |
| 4,321,660 | A * | 3/1982 | Sokol | F21L 14/02 | 362/368 |
| 4,533,982 | A * | 8/1985 | Kozar | F21V 23/0414 | 362/183 |
| 5,558,428 | A * | 9/1996 | Lehrer | F21L 14/00 | 362/105 |
| 5,993,022 | A | 11/1999 | Neyer et al. | | |
| 6,315,426 | B1 * | 11/2001 | Buller, Jr. | A45F 3/14 | 362/103 |
| 6,616,303 | B1 * | 9/2003 | Rosset | F21S 10/02 | 362/240 |
| 6,711,006 | B2 * | 3/2004 | Chen | F16M 11/14 | 248/231.31 |
| 6,733,153 | B1 * | 5/2004 | Lee | F21L 4/00 | 362/191 |
| 6,802,623 | B1 * | 10/2004 | Hsu | F21L 4/04 | 362/188 |
| 6,877,880 | B2 | 4/2005 | Endo | | |

(Continued)

*Primary Examiner* — Laura K Tso
(74) *Attorney, Agent, or Firm* — Seyfarth Shaw LLP

(57) ABSTRACT

An illumination device having a body with attributes of a swivel/universal socket and/or typical ball-and-socket joint. The illumination device can be releasably coupled to surfaces and illuminate a specified surface by aiming the illumination device without needing to also move the base. Once the illumination device is aimed to illuminate the area of interest, the light body will remain in this position until further user input.

18 Claims, 13 Drawing Sheets

(56) References Cited

U.S. PATENT DOCUMENTS

| | | | | |
|---|---|---|---|---|
| 6,986,590 | B1 * | 1/2006 | Padden | A44B 15/005 362/116 |
| 7,172,310 | B2 | 2/2007 | Hsu | |
| 7,217,013 | B2 * | 5/2007 | Endo | F16M 11/14 362/190 |
| 7,896,520 | B1 * | 3/2011 | Norling | A47J 43/283 362/191 |
| 8,142,045 | B2 | 3/2012 | Peak | |
| 8,277,095 | B2 * | 10/2012 | Juang | F21K 9/65 362/421 |
| 8,317,374 | B2 * | 11/2012 | Hedrick | F21V 15/02 362/398 |
| 8,545,066 | B2 | 10/2013 | Coleman et al. | |
| 8,777,446 | B2 | 7/2014 | Sharrah et al. | |
| 8,967,564 | B2 * | 3/2015 | Colarusso | F16M 13/02 248/219.3 |
| 9,587,671 | B2 | 3/2017 | Bao | |
| 9,851,082 | B2 | 12/2017 | Thompson et al. | |
| 10,107,484 | B2 * | 10/2018 | Moyers | F21V 21/096 |
| 2005/0265033 | A1 | 12/2005 | Yang | |
| 2007/0014101 | A1 * | 1/2007 | Huang | F21V 21/088 362/119 |
| 2007/0103917 | A1 | 5/2007 | Wu et al. | |
| 2009/0027900 | A1 * | 1/2009 | Janos | F21V 29/773 362/373 |
| 2014/0321904 | A1 * | 10/2014 | Bao | F16C 11/06 403/132 |
| 2015/0109769 | A1 * | 4/2015 | Chang | F21V 21/145 362/191 |
| 2015/0131276 | A1 * | 5/2015 | Thompson | F21V 21/096 362/191 |
| 2019/0162396 | A1 * | 5/2019 | Sonneman | F21V 21/30 |

* cited by examiner

PIVOTING SWIVEL ILLUMINATION DEVICE

TECHNICAL FIELD OF THE INVENTION

The present invention relates generally to illumination devices. More particularly, the present invention relates to illumination devices that pivot and/or swivel.

BACKGROUND OF THE INVENTION

Illumination devices, such as flashlights, are often used in areas that are dimly lit and have restricted space, making it difficult to perform certain jobs. It is preferable to mount the illumination device in restricted spaces and aim the illumination device to illuminate a desired surface without requiring a user to hold the device. Illumination devices can be coupled to mountable bases that allow for some adjustment to aim the illumination device, such as flashlight holders. A variety of illumination devices are also known, such as LED penlights, lights with bendable shafts, platform lights mounted to bases that can slide and swivel, etc. However, current illumination devices are usually bulky, have limited aiming adjustments, and/or require a user to hold the device.

SUMMARY OF THE INVENTION

The present invention broadly relates to an illumination device, such as a compact flashlight, a lamp, a magnifying glass, etc., having a body with attributes of a swivel/universal socket and/or typical ball-and-socket joint for 360 degree adjustment and one or more illumination sources disposed along an internal perimeter of the body. The illumination device can have a base adapted to be releasably coupled to surfaces and illuminate a specified area by aiming the illumination device without the need to move the base. Once the illumination device is aimed to illuminate the area of interest, the body will remain in this position until further manipulated by the user. Once aimed, the user does not need to hold the device in position. Accordingly, the illumination device is more compact and has improved aiming adjustments as compared to the current art.

In an embodiment, the present invention broadly includes an illumination device including a base adapted to releasably couple to a surface, a body coupled to the base with a pivoting coupling, and an illumination source disposed along an internal perimeter of the body.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
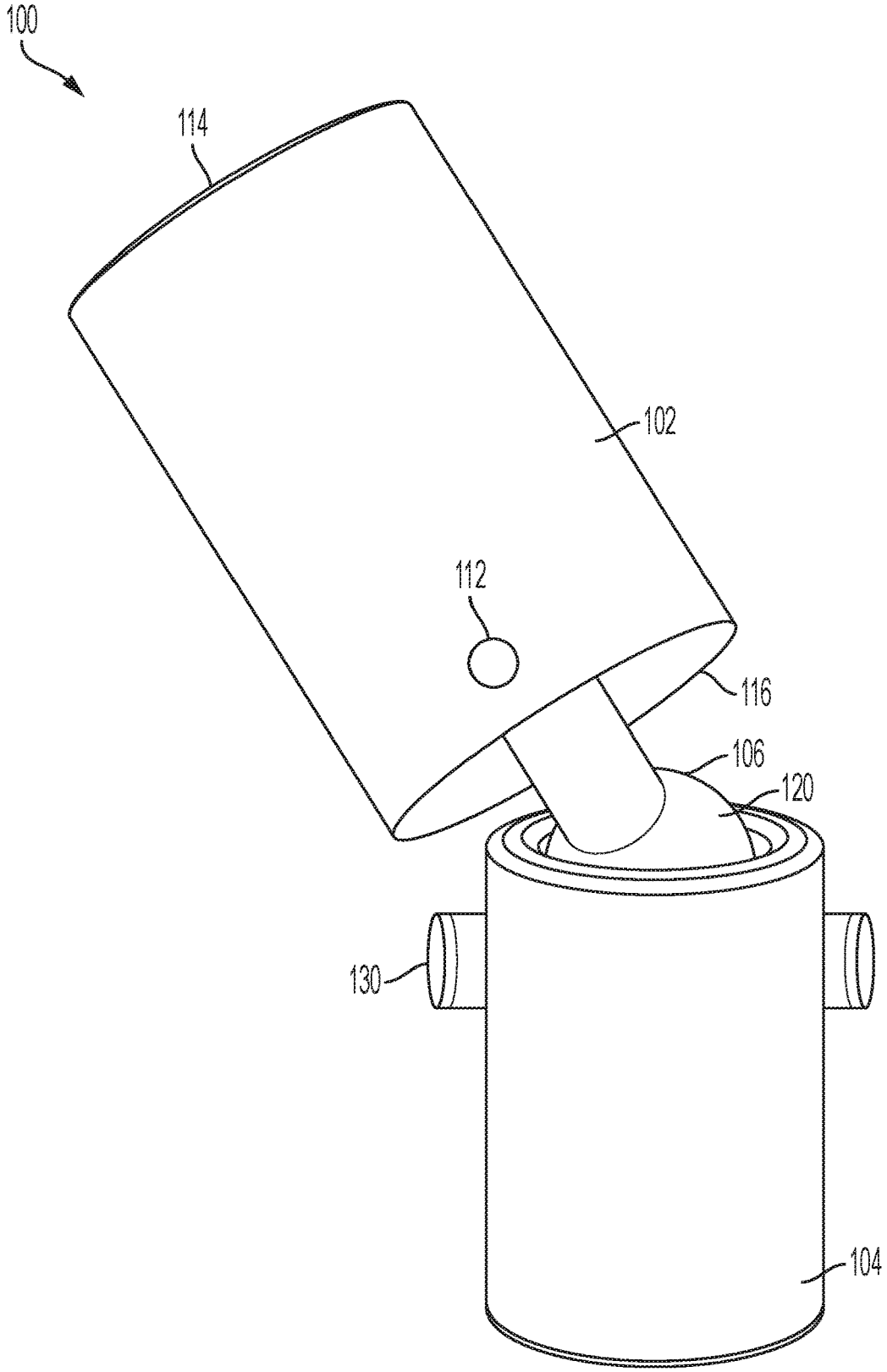
FIG. 1 is a perspective view of an illumination device according to an embodiment of the present invention.
Figure 2:
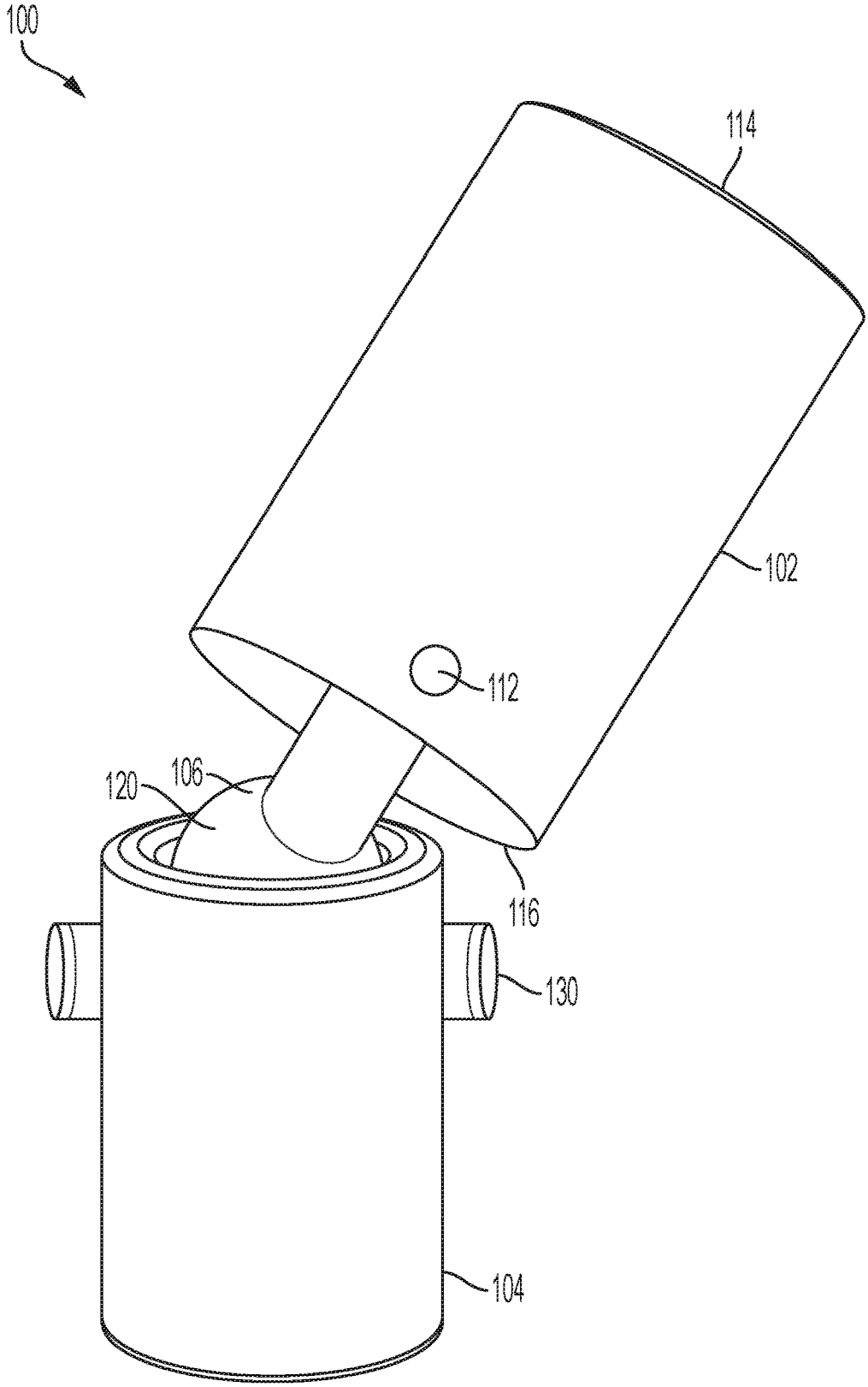
FIG. 2 is another perspective view showing a body of the illumination device of FIG. 1 in a different position.
Figure 3:
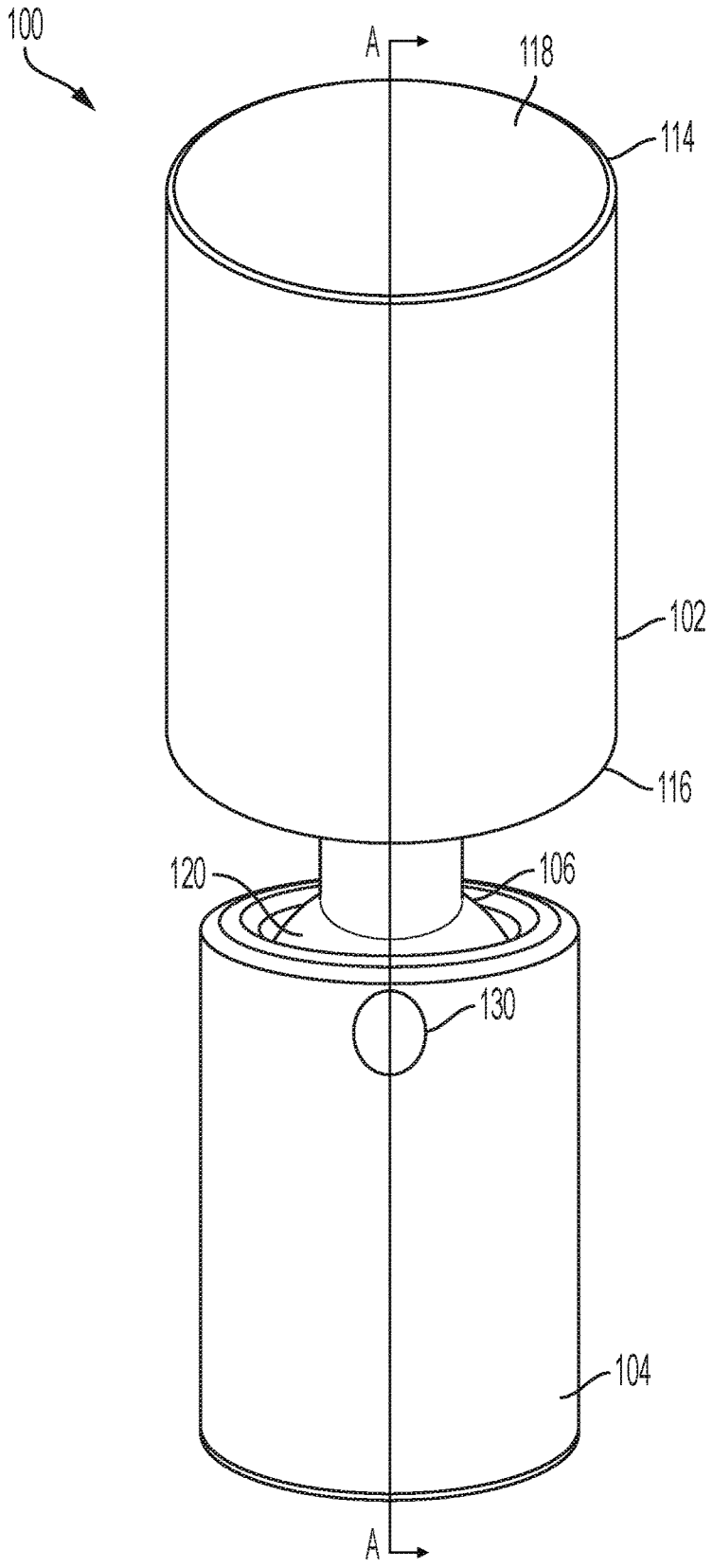
FIG. 3 is another perspective view showing a body of the illumination device of FIG. 1 in a different position.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly relates to an illumination device including a base adapted to releasably couple to a surface, a body coupled to the base with a pivoting coupling, and one or more illumination sources disposed along an internal perimeter of the body.

Referring to FIGS. 1 through 13, an illumination device 100 may be removably coupled to a surface to direct where additional illumination is desired. The illumination device 100 can have 360 degrees of adjustability by swiveling and/or pivoting to allow the user to aim the light where needed.

The illumination device 100 may include a body 102 and a base 104. The base 104 is rotatably and/or pivotably coupled to the body 102 via a pivoting coupling 106, which will be discussed in more detail below. The illumination device 100 may be a lamp, a magnifying glass, a flashlight, or any other suitable device that provides illumination to a dimly lit area.

The body 102 may be hollow and cylindrical. Although, the body 102 may be various geometric shapes, such as rectangular, square, etc., and adapted to contain an illumination source 108, a power source 110, a switch 112, etc., which will be discussed in more detail below.

The body 102 can include a first end 114 and a second end 116. The first end 114 can be open to allow light from the illumination source 108 to pass through. Additionally, or alternatively, the first end 114 can include a light cover 118 or lens to prevent debris from falling into the body 102 and/or to diffuse the light emitting from the illumination source 108.

The pivoting coupling 106 can be a ball and socket coupling that includes a ball 120 and a socket. The ball 120 can be coupled to or formed on the second end 116 of the body 102. The ball 120 is adapted to fit inside and be retained by the socket of the pivoting coupling 106. In an embodiment, a pin 130 and the base 104 may function as the socket, discussed below. In another embodiment, a retaining cap 122 and the base 104 may function as the socket, discussed below. The pivoting coupling 106 allows the body 102 to swivel and/or pivot 360 degrees relative to the base 104.

Figure 4:
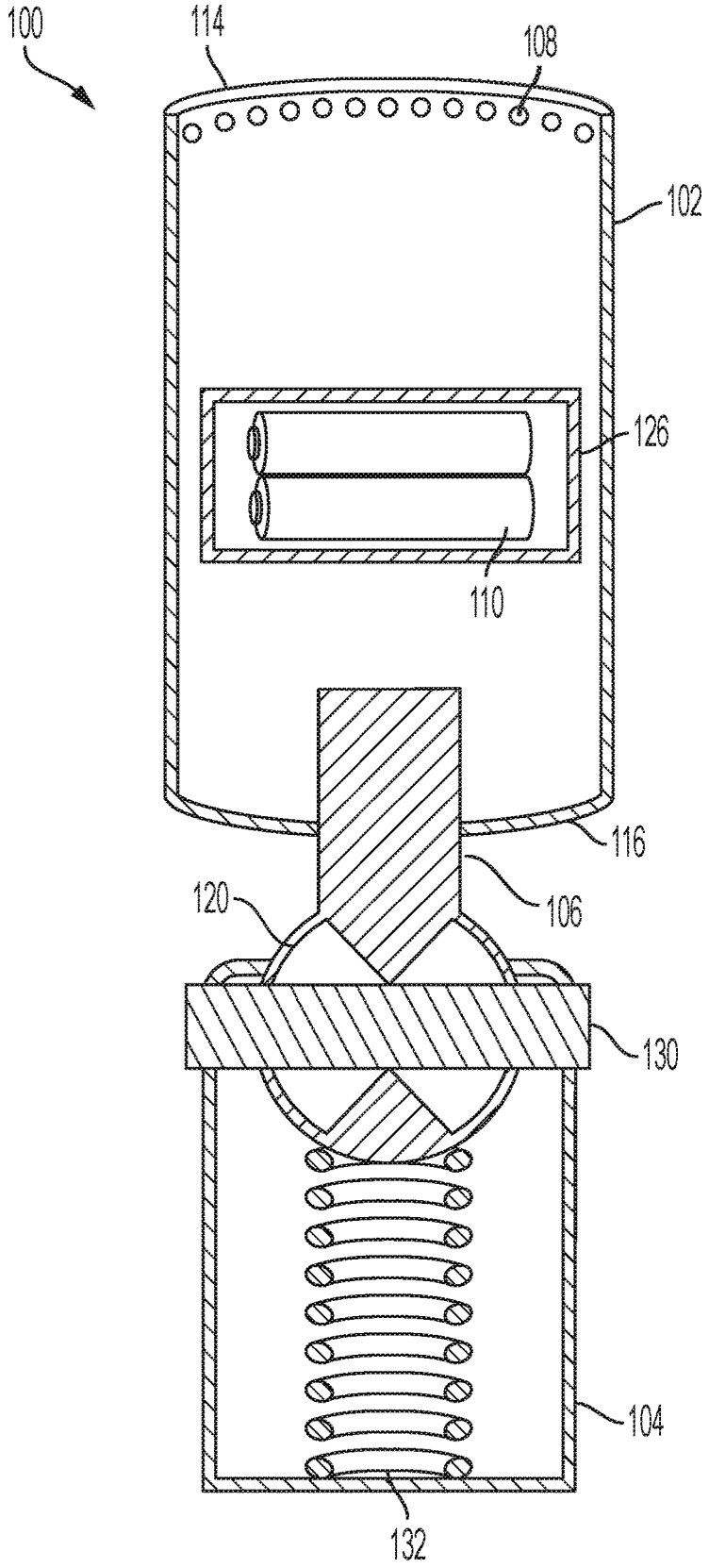
FIG. 4 is a section view of the illumination device of FIG. 1 taken along line A-A of FIG. 3.
Figure 5:
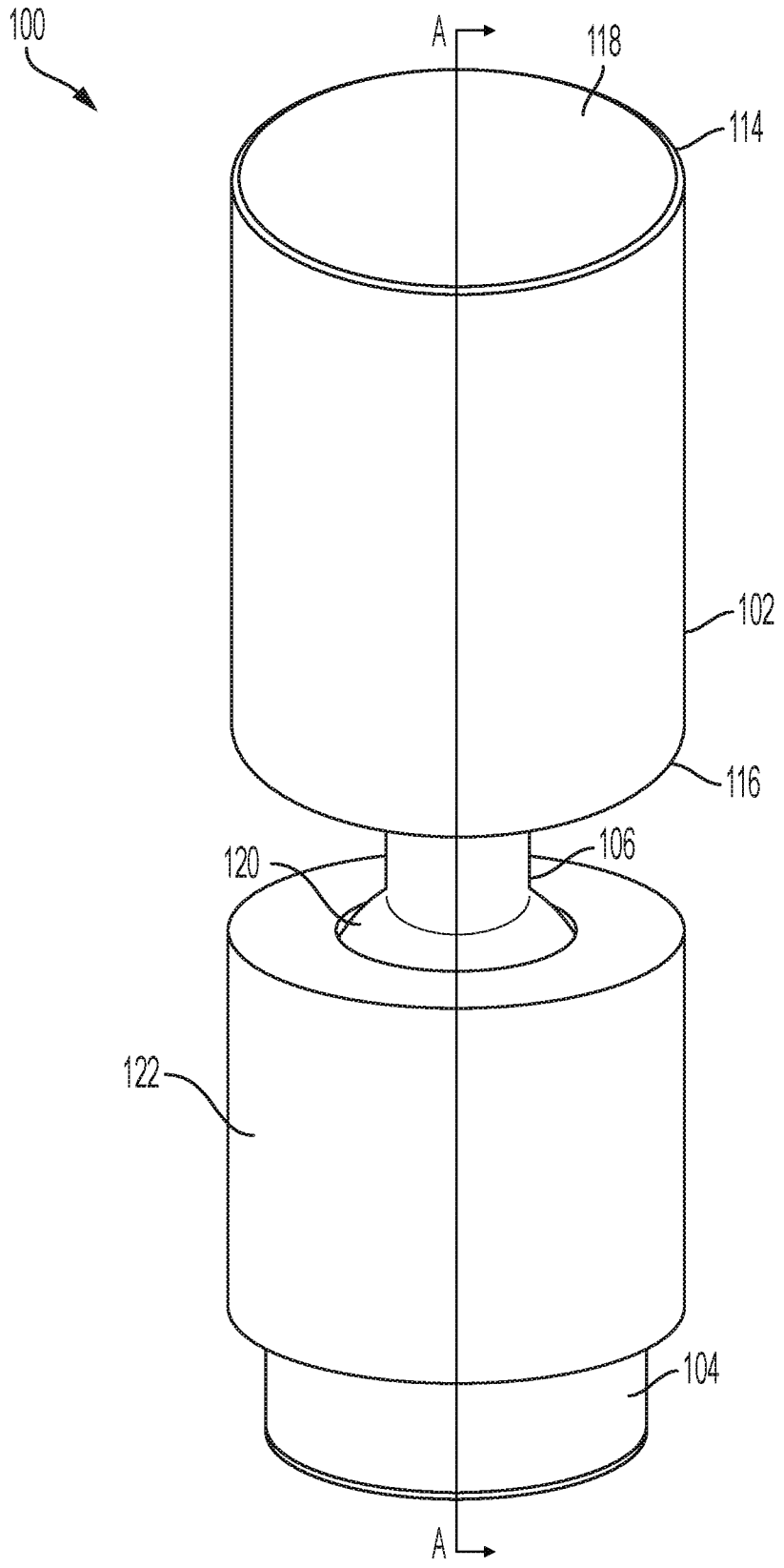
FIG. 5 is a side perspective view of an illumination device according to another embodiment of the present invention.
Figure 6:
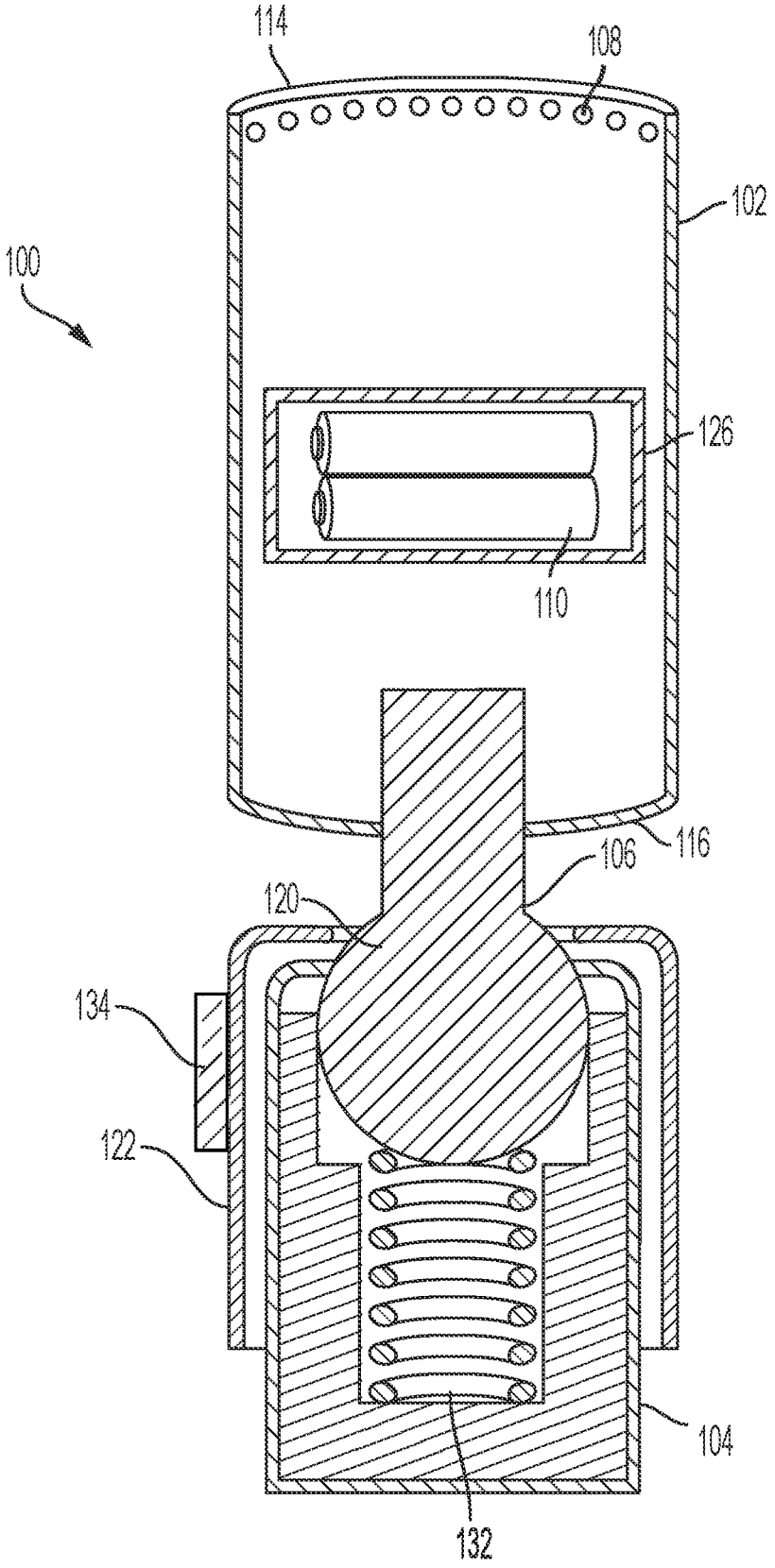
FIG. 6 is a section view of the illumination device of FIG. 5 taken along line A-A of FIG. 5.
Figure 8:
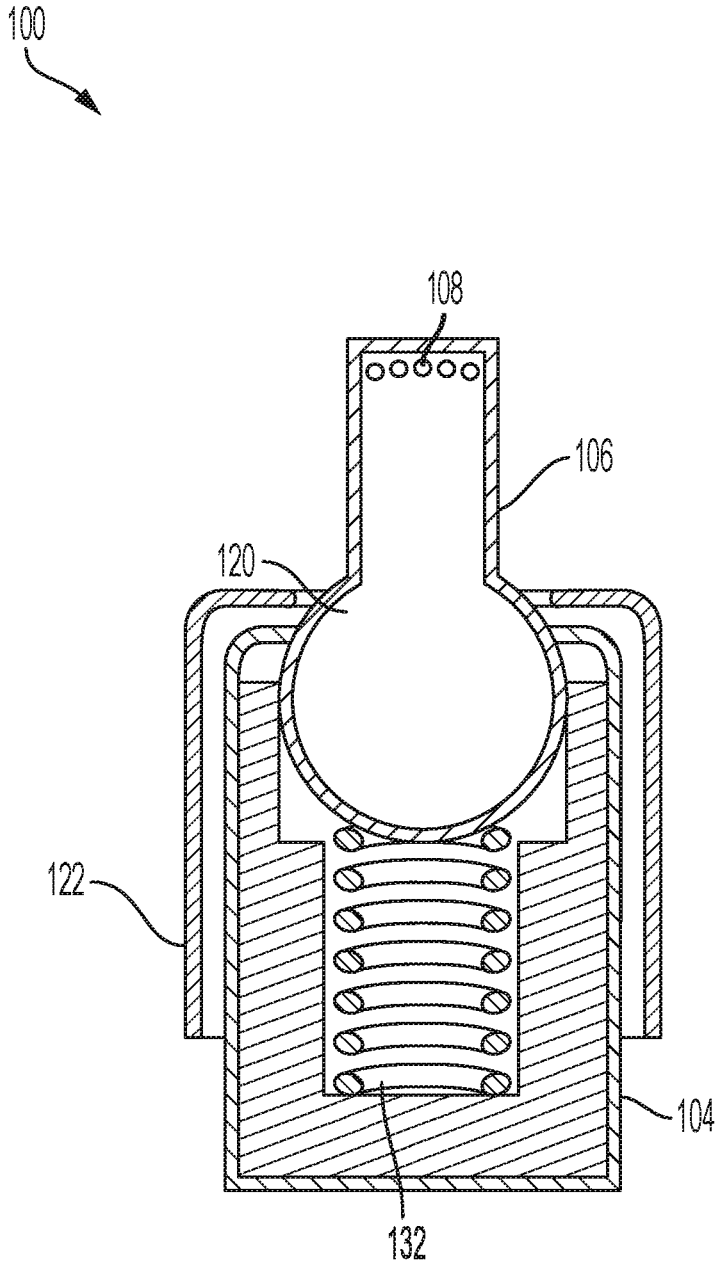
FIG. 8 is a section view of the illumination device of FIG. 7 taken along line A-A of FIG. 7.
Figure 12:
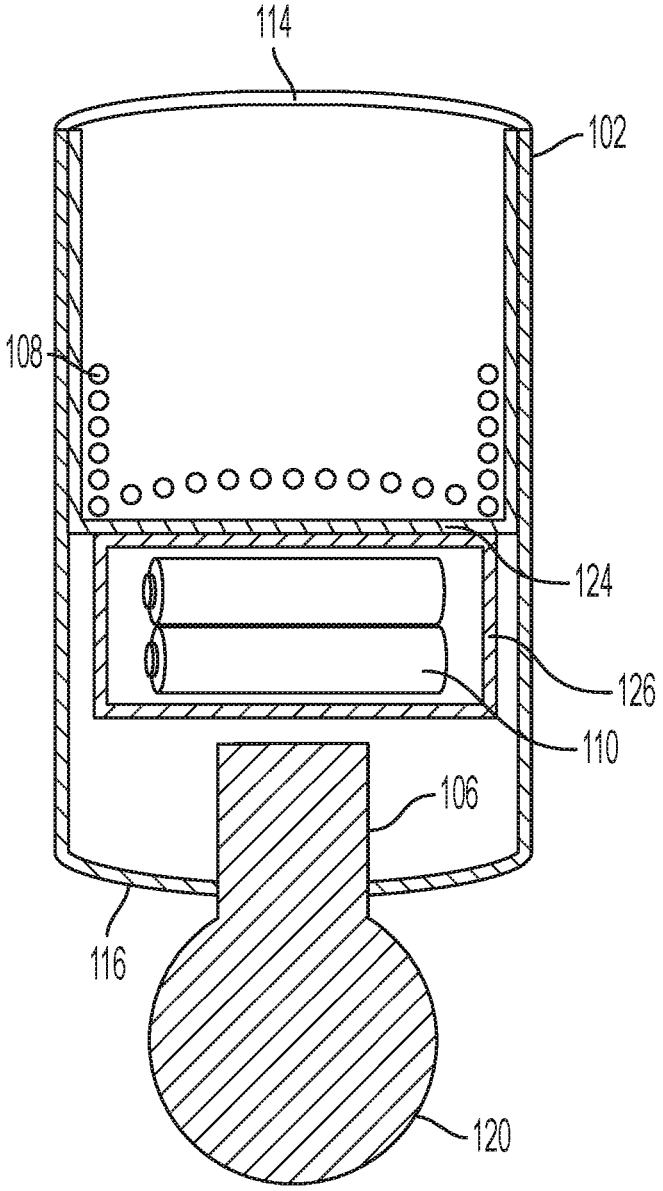
FIG. 12 is a section view of a body of the illumination device of FIG. 1 taken along line A-A of FIG. 3 according to another embodiment of the present invention.
Figure 13:
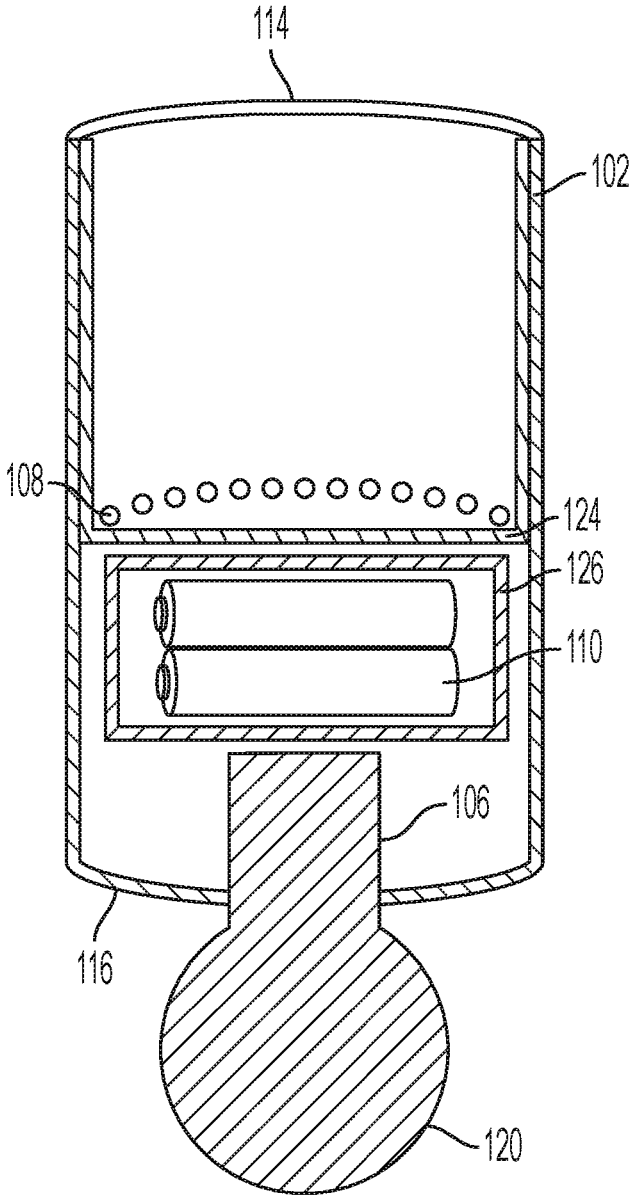
FIG. 13 is a section view of a body of the illumination device of FIG. 1 taken along line A-A of FIG. 3 according to another embodiment of the present invention.

The illumination source 108 can be long lasting, low power consumption LEDs or other suitable light emitting sources, such as light bulbs or the like. The illumination source 108 is positioned and directed to emit light from the body 102, as described above. The illumination source 108 can be disposed along an internal perimeter of the body 102. As shown in FIGS. 4 and 6, the illumination source 108 can be disposed along an internal circumference proximate to the first end 114 of the body 102. In an embodiment the illumination source 108 can be disposed along an internal circumference proximate to an end of the pivoting coupling 106, as shown in FIG. 8. In an embodiment, the illumination source 108 is disposed along an internal circumference proximate to a center of the body 102, as shown in FIGS. 12 and 13. In an embodiment, the illumination source 108 is arranged in an axial direction along interior walls of the body 102, as shown in FIG. 12. In an embodiment, the illumination source 108 is disposed in a radial direction along an interior surface 124 of the body 102 and in an axial direction along the interior walls of the body 102, thereby forming a "U" (not shown).

The power source 110 is adapted to provide energy to illuminate the illumination source 108. The power source 110 can be or can include, but is not limited to, a battery, such as a DC battery, a rechargeable battery, or the like. In an embodiment, the power source 110 can be AC power. If a rechargeable power source, the charging means can be wired or wireless. The power source 110 can be housed in a separate compartment 126 within the body 102. If desired, the power source 110 can be accessible by removing a portion of the body 102, such as a battery door (not shown), to recharge or replace the battery as needed. The power source 110 also need not be housed within the body 102. The power source 110 can instead be housed in the base 104.

The switch 112 can be positioned on or in the body 102 or the base 104. The switch 112 can have an actuation mechanism that employs a push button actuator, switch, or other type of actuator to activate or operate the switch 112. In an embodiment, the switch 112 can be a toggle actuator, a touch sensitive actuator, a slide actuator, or other suitable actuator or device. The switch 112 is used to turn the illumination source 108 ON and OFF. In another embodiment (not shown) the switch 112 is actuated when the illumination device 100 is coupled to a surface using a connection means 134, which is discussed in more detail below. In this embodiment, the illumination source 108 can be turned ON and OFF without requiring the operator to push the actuation mechanism. When the illumination device 100 decouples from the surface, the illumination device is turned OFF.

Figure 7:
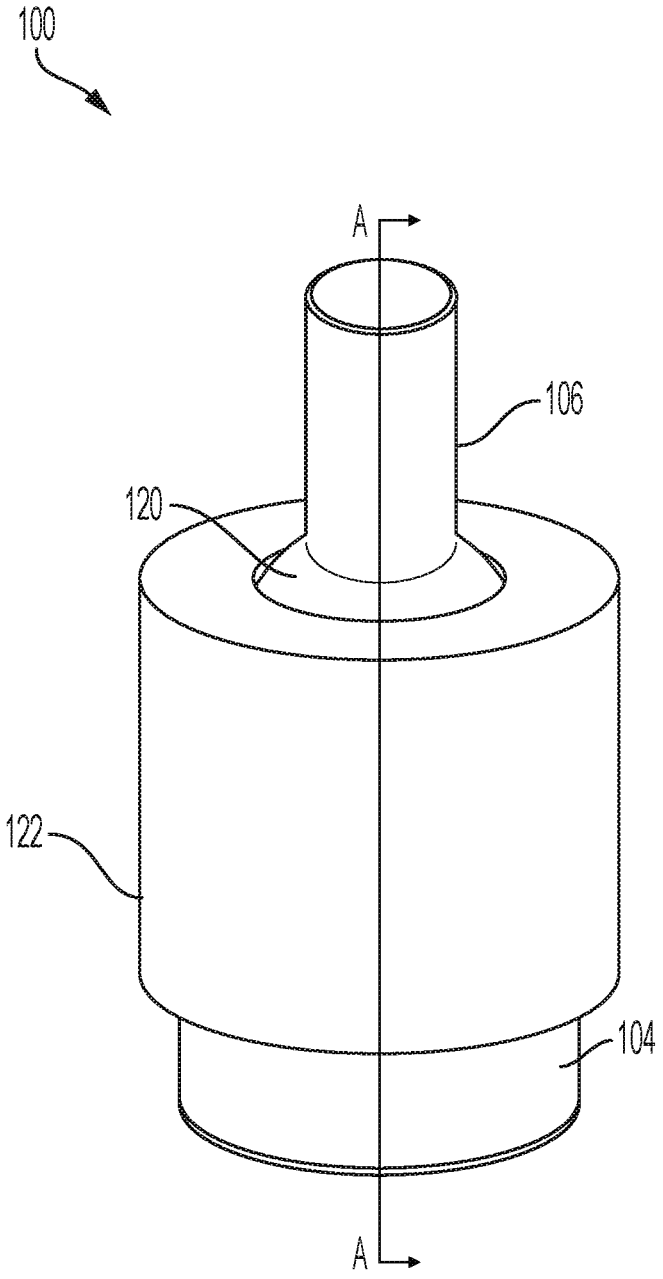
FIG. 7 is a side perspective view of an illumination device according to another embodiment of the present invention.

As discussed above, the switch 112, the power source 110, the illumination source 108, and other components can be housed within the body 102. In another embodiment, the switch 112, the power source 110, the illumination source 108, and/or the other components can be housed within the ball 120 of the ball and socket coupling. In this embodiment, the illumination device 100 may not include the body 102, as shown in FIGS. 7 and 8. The illumination device 100 may also include a circuit board (not shown) to which the various components are coupled. The switch 112, the power source 110, and the illumination source 108 can be connected to the circuit board and thus to one another via the board, as is known in the art. The illumination source 108 may be disposed on the board. Wires may be used to connect the various components to the circuit board. Electrical contacts can be provided as well between the various components and the circuit board. The functional design of these components can vary considerably within the spirit and scope of the present invention.

The base 104 may be hollow and cylindrical, although the base 104 may be other various geometric shapes as well, such as square, rectangular, etc. The base 104 can have an open end adapted to receive and retain the ball 120. In an embodiment, the base 104 can be adapted to function as a socket of the ball and socket coupling. This can be achieved various ways, including, but not limited to, the use of the pin 130 passing though the ball 120, or with the retaining cap 122 coupled to the base 104 and adapted to retain the ball 120 in the base 104. For the pin style embodiment, the base 104 can have two apertures 128 adapted to receive the pin 130 that retains the ball 120 in the base 104. In the retaining cap style embodiment, the base 104 can be coupled to the retaining cap 122 to retain the ball 120 therein and compress the spring 132. The retaining cap 122 can be pressed, crimped, threaded, or the like on the base 104.

A spring 132 may be housed in the base 104. The spring 132 can be preloaded to exert an axial force against the ball 120. This axial force allows the body 102 to maintain its position without user manipulation. In another embodiment (not shown) a spring 132 can apply a radial force against the ball 120. The radial force allows the body 102 to maintain its position without user manipulation. The spring 132 can be a coil spring, or other suitable biasing member that can provide the axial or radial force to maintain the illuminated position of the illumination device 100.

Figure 9:
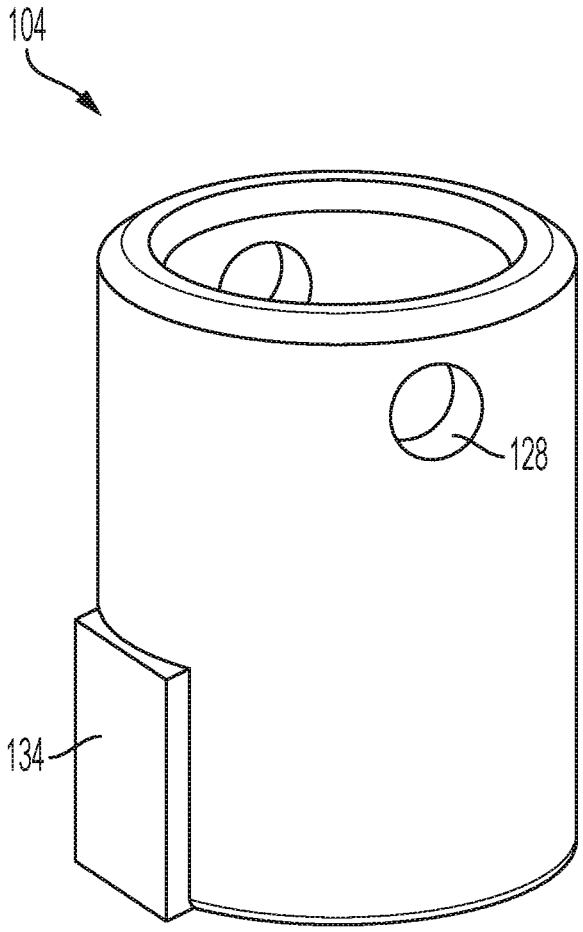
FIG. 9 is a perspective view of a base of the illumination device of FIG. 1 according to an embodiment of the present invention.
Figure 10:
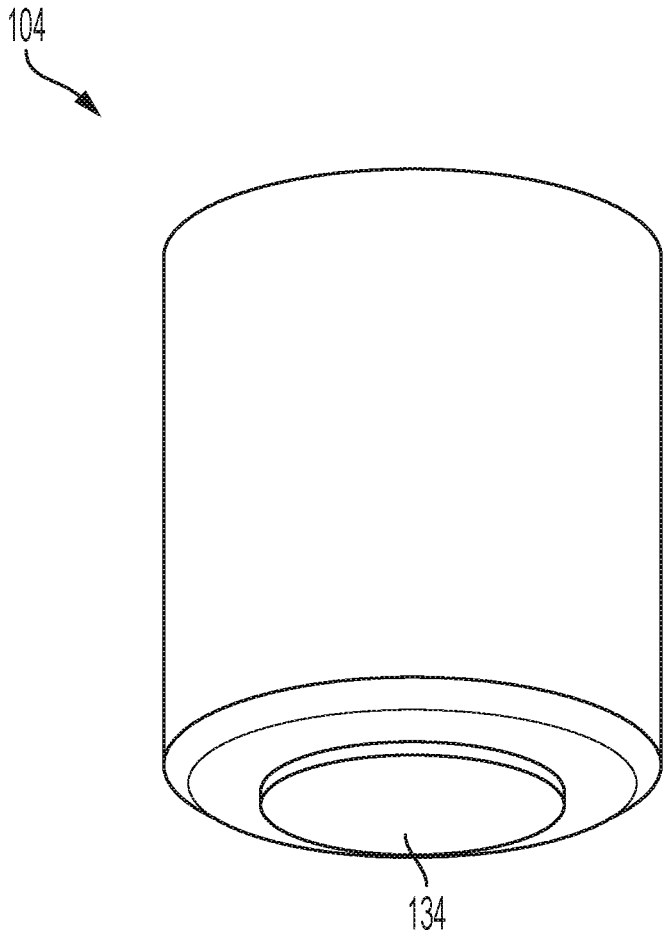
FIG. 10 is a perspective view of a base of the illumination device of FIG. 1 according to another embodiment of the present invention.
Figure 11:
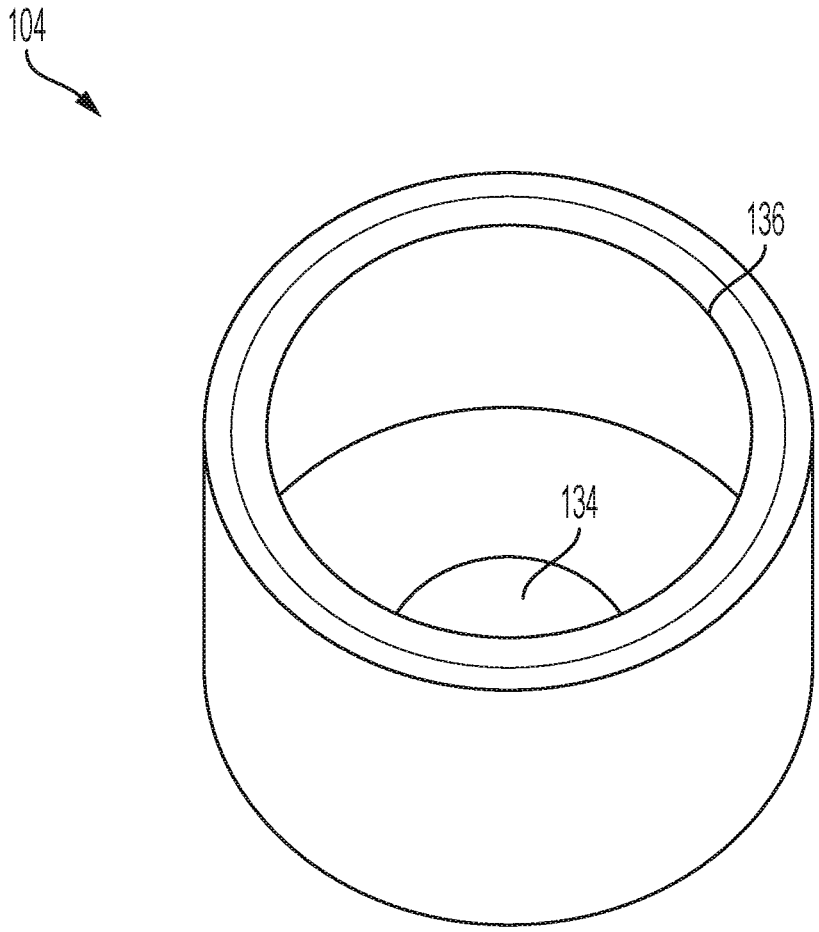
FIG. 11 is a perspective view of a base of the illumination device of FIG. 1 according to another embodiment of the present invention.

In an embodiment, the base 104 can include a connection means 134 that allows for hands free use of the illumination device 100. The connection means 134 can be coupled to or otherwise mounted on a bottom, outside surface of the base 104 (as shown in FIG. 10), a side of the base 104 (as shown in FIG. 9), or in a cavity 136 inside the base 104 on a bottom, inside surface of the base 102 (as shown in FIG. 11). In another embodiment (not shown), the connection means 134 can be coupled to or otherwise mounted on an outside surface of the cap 122. The connection means 134 may be a magnet that allows the illumination device 100 to be coupled to a ferromagnetic surface. The connection means 134 can also be a clamp, a suction cup, or any other suitable means that allows for hands free use of the illumination device 100.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. An illumination device comprising:

a pin;

a base including an aperture adapted to receive the pin, wherein the base is adapted to releasably couple with a surface;

a body coupled to the base;

a ball and socket coupling retained to the base by the pin, thereby coupling the body to the base, wherein the pin extends through the ball and socket coupling; and an illumination source disposed inside of the body.

2. The illumination device of claim 1, wherein the base is hollow and cylindrical.

3. The illumination device of claim 1, wherein a ball of the ball and socket coupling is coupled to the body.

4. The illumination device of claim 1, wherein the base includes a magnet, and wherein the surface is a ferromagnetic surface and the magnet is adapted to releasably couple to the ferromagnetic surface.

5. The illumination device of claim 4, wherein the magnet is disposed on a side surface of the base.

6. The illumination device of claim 4, wherein the magnet is disposed on a bottom surface of the base.

7. The illumination device of claim 4, wherein the magnet is disposed inside the base.

8. The illumination device of claim 1, further comprising a power source adapted to provide energy to illuminate the illumination source; and a switch adapted to turn the illumination source ON and OFF.

9. The illumination device of claim 8, wherein the power source is housed in a compartment within the body, and the switch is disposed on the body.

10. The illumination device of claim 1, further comprising a spring disposed in the base and adapted to exert an axial force on the pivoting coupling.

11. The illumination device of claim 1, wherein the body is hollow and cylindrical.

12. The illumination device of claim 1, wherein the illumination source is disposed proximate to an end of the body.

13. The illumination device of claim 1, wherein the illumination source is disposed at a center of the body.

14. The illumination device of claim 1, further comprising a spring disposed in the base and adapted to exert a radial force on the pivoting coupling.

15. The illumination device of claim 1, wherein the illumination source is disposed along an internal perimeter of the body.

16. An illumination device comprising:

a base;

a retaining cap coupled to the base, the retaining cap adapted to releasably couple with a surface external to the illumination device;

a ball and socket coupling, wherein the retaining cap is adapted to couple a ball of the ball and socket coupling to the base;

a body coupled to the base via the ball and socket coupling; and an illumination source disposed inside of the body.

17. The illumination device of claim 16 further comprising a magnet disposed on the cap.

18. An illumination device comprising:

a base adapted to releasably couple with a surface;

a body coupled to the base;

a pivoting coupling that couples the body to the base; and an illumination source disposed in an axial direction along an interior wall of the body and in a radial direction along an interior surface of the body.

* * * * *